US010501991B2

(12) United States Patent
Umlor

(10) Patent No.: US 10,501,991 B2
(45) Date of Patent: Dec. 10, 2019

(54) MULTI-AXIAL POSITION ADJUSTABLE LADDER SUPPORT ASSEMBLY AFFIXED TO AN ELEVATED MOUNTING LOCATION

(71) Applicant: Terrence L. Umlor, Kingsley, MI (US)

(72) Inventor: Terrence L. Umlor, Kingsley, MI (US)

( * ) Notice: Subject to any disclaimer, the term of this patent is extended or adjusted under 35 U.S.C. 154(b) by 44 days.

(21) Appl. No.: 15/840,157

(22) Filed: Dec. 13, 2017

(65) Prior Publication Data

US 2018/0171715 A1 Jun. 21, 2018

Related U.S. Application Data

(60) Provisional application No. 62/434,813, filed on Dec. 15, 2016.

(51) Int. Cl.
*E06C 7/48* (2006.01)

(52) U.S. Cl.
CPC ..... *E06C 7/48* (2013.01)

(58) Field of Classification Search
CPC ..... E06C 7/48; E06C 7/482; E06C 7/505
USPC ..... 248/124.1, 278.1, 282.1, 283.1, 284.1, 248/285.1, 287.1, 286.1, 354.1, 354.5, 248/220.22, 220.41, 220.42, 220.43
See application file for complete search history.

(56) References Cited

U.S. PATENT DOCUMENTS 1,380,121 A * 5/1921 Stitzer ..... F21V 21/26 248/278.1
3,708,080 A 1/1973 Schlei
3,713,510 A * 1/1973 O'Dell ..... E06C 7/48 182/107
3,878,917 A * 4/1975 McBride ..... E06C 1/20 182/172
4,580,660 A 4/1986 Oling
4,601,253 A * 7/1986 Anders ..... B63B 27/146 114/362
5,211,601 A * 5/1993 Cope ..... A22B 5/06 452/128
5,298,004 A * 3/1994 Davis ..... A63B 21/0628 482/102
5,842,672 A * 12/1998 Sweere ..... A47B 21/00 248/278.1
6,152,261 A 11/2000 Hoey
(Continued)

FOREIGN PATENT DOCUMENTS

GB 2536611 A 9/2016

*Primary Examiner* — Colleen M Chavchavadze
*Assistant Examiner* — Shiref M Mekhaeil
(74) *Attorney, Agent, or Firm* — Dinsmore & Shohl LLP

(57) ABSTRACT

An assembly adapted to being affixed to an elevated location in order to provide a ladder support surface. The assembly includes an anchoring base subassembly, an elongated arm extending from the subassembly and a head mounted to an end of the arm and including an elongated crosswise member adapted to support an upper location of a ladder. Additional features include at least one pivot axis established between the base subassembly and the arm and at least one additional pivot axis between the arm and the head. The base subassembly further includes a fixed mounting portion and a pivotally adjusted outer portion. The fixed mounting portion further includes a wall mount plate from which extends a pair of radial support plates, between which is received a pivotally supporting location of the outer portion to define a first of the at least one pivot axis.

6 Claims, 12 Drawing Sheets

(56) References Cited

U.S. PATENT DOCUMENTS 6,264,152 B1 * 7/2001 Bloch ..... F16M 11/126 248/274.1
6,371,429 B1 * 4/2002 Gillespie ..... A47G 33/1246 248/286.1
6,427,803 B1 8/2002 Moore
6,527,084 B2 * 3/2003 Hrincu ..... E06C 1/22 182/172
6,550,577 B1 4/2003 Allgire
7,163,084 B1 * 1/2007 Blehm ..... E06C 7/423 182/172
7,334,956 B2 * 2/2008 Taylor ..... B63B 35/815 114/361
7,490,813 B1 * 2/2009 Weddle ..... A62B 3/005 248/354.1
7,703,733 B2 * 4/2010 Price ..... F16M 11/2064 248/276.1
7,954,777 B2 * 6/2011 Bohm ..... F16M 11/10 248/274.1
8,087,624 B2 * 1/2012 Varney ..... F16M 11/10 248/125.8
8,196,883 B2 * 6/2012 Hirschhorn ..... F16M 11/041 248/274.1
9,771,756 B1 * 9/2017 Gregoire ..... E06C 7/42
2003/0038150 A1 * 2/2003 Williams ..... B60R 7/14 224/401
2006/0272894 A1 12/2006 Hein et al.
2008/0169154 A1 7/2008 Hein et al.
2008/0169155 A1 * 7/2008 Broberg ..... A01M 31/02 182/187
2008/0190692 A1 8/2008 Feik
2009/0008524 A1 * 1/2009 Huang ..... F16M 11/10 248/278.1
2011/0017549 A1 * 1/2011 Lietz ..... E06C 1/06 182/172
2011/0315476 A1 * 12/2011 Clarkson ..... E06C 7/48 182/107
2013/0055619 A1 * 3/2013 Stewart ..... A01M 31/008 43/1
2013/0055648 A1 3/2013 Snyder
2013/0161465 A1 * 6/2013 Huang ..... F16M 11/08 248/278.1
2013/0205645 A1 * 8/2013 Gaskamp ..... A01M 23/16 43/62
2014/0141906 A1 * 5/2014 Hulbert ..... A63B 71/022 473/415
2015/0204140 A1 * 7/2015 Umlor ..... E06C 7/48 182/165
2016/0109058 A1 * 4/2016 Bennett ..... A47B 81/00 248/280.11
2016/0153234 A1 * 6/2016 Mazanek ..... E06O 7/06 182/129
2016/0208554 A1 * 7/2016 Harris ..... E06C 7/188
2016/0208555 A1 * 7/2016 Dehoff ..... E06C 7/48
2017/0050074 A1 * 2/2017 Olson ..... A63B 21/154
2017/0051509 A1 * 2/2017 Marshall ..... E04D 13/103
2019/0048662 A1 * 2/2019 Beasse ..... E06C 7/48

* cited by examiner

FIG. 12B
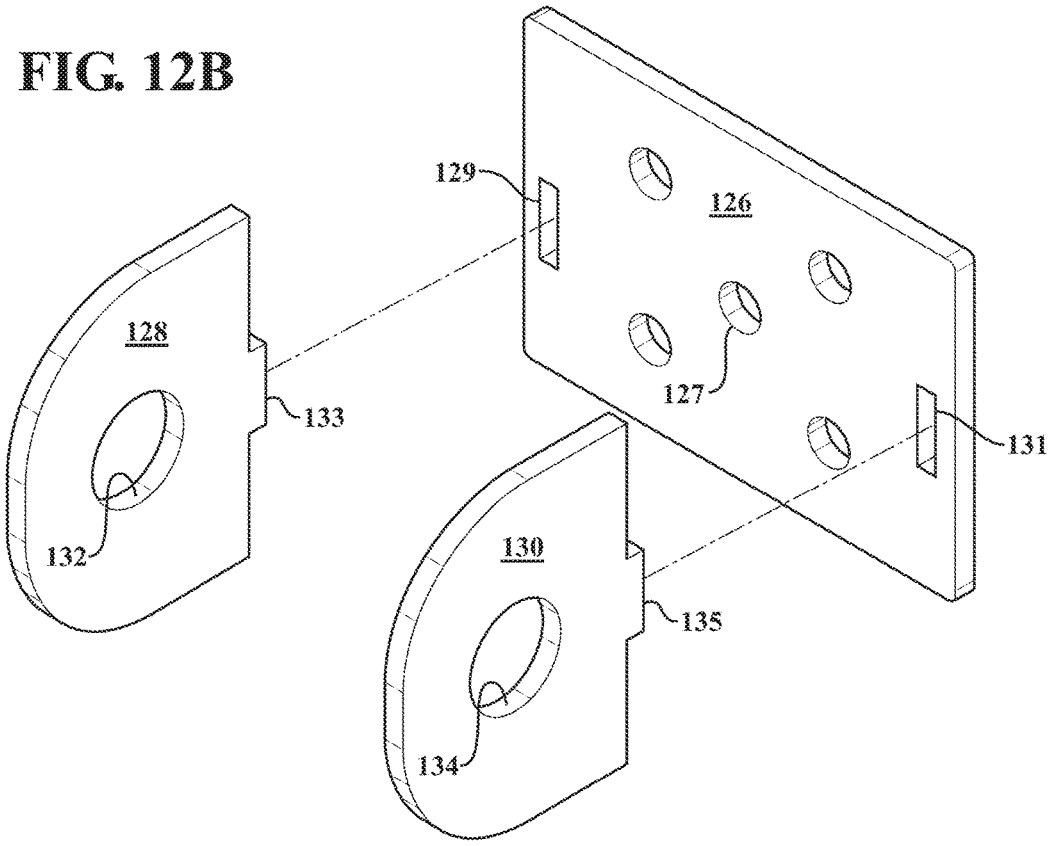
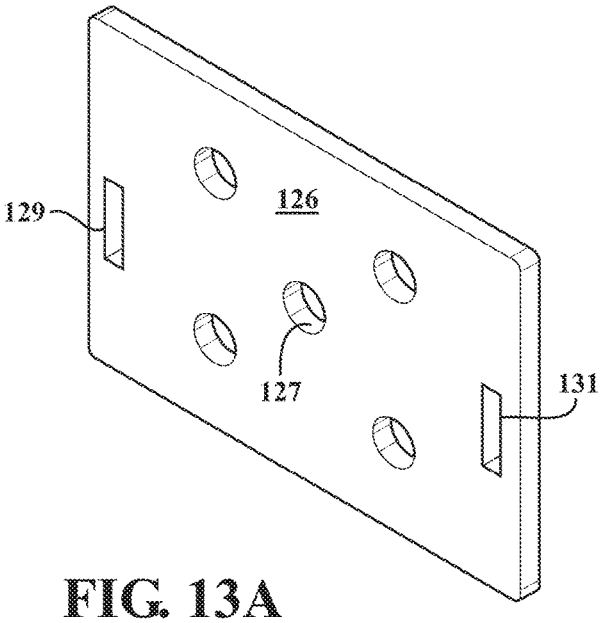
FIG. 13A
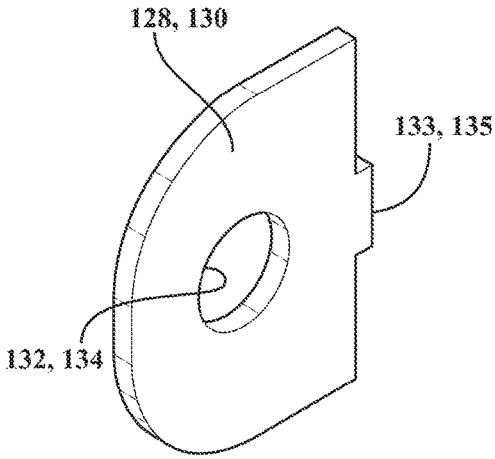
FIG. 13B

MULTI-AXIAL POSITION ADJUSTABLE LADDER SUPPORT ASSEMBLY AFFIXED TO AN ELEVATED MOUNTING LOCATION

CROSS REFERENCE TO RELATED APPLICATIONS

The present application claims priority from U.S. Ser. No. 62/434,813 filed Dec. 15, 2016.

FIELD OF THE INVENTION

The present invention relates generally to a ladder support assembly which is anchored or affixed to an elevated location, in a desired orientation, for supporting an upper portion of a ladder. The assembly includes a base or wall mount bracket which is anchored or otherwise affixed, the assembly also including multiple articulating axes which are each adjusted or readjusted and subsequently fixed in a desired orientation (such as via pins seating through aligning apertures) associated with desired access to the elevated work environment. An elongated tube having inner and outer telescoping portions extends from the wall mount bracket and, at an extending end, supports a head weldment with a crosswise extending ladder support rod for providing secure positional support of the ladder when leaned against the tube. A pulley is supported at such as an end location of the head weldment or crosswise supported tube and, in use with a lanyard, facilitates the ability to transport items between ground and elevated locations, such as by a user standing on the ladder in proximity to the support assembly.

DESCRIPTION OF THE BACKGROUND ART

The prior art discloses a number of ladder support and location devices, such enabling the secure placement of a ladder for ascending by a user engaged in a given task. The ladder support devices can include those which secure to the ladder for abutting against the elevated location and, in given instances, mounting instead to the elevated location and against which the upper end of the ladder is contacted in a desired orientation.

Allgire, U.S. Pat. No. 6,550,577 teaches a safety device for securing a ladder to more than one structural type. The device includes a base, having one or more connection holes, designed to secure the safety device to a first structure type through the connection holes. A securing section is coupled to the base section and designed to secure the safety device to a second structure type. The device may optionally include a support, removably coupled to the base, designed to engage a front edge of a gutter, to prevent structural damage to the gutter when the ladder rests on the gutter. A removable bracket portion having one or more bracket connection holes is perpendicularly oriented and coupled to the base and designed to secure the safety device to a third structure type, through the bracket connection holes, when the support engages the front edge of the gutter.

Feik, US 2008/0190692 teaches a ladder anchor mounted to the side rails of a ladder and having jointed arms that are positioned on each side of the ladder and extend outwardly. The arms have arm sections that are capable of being positively adjusted as to their angular position, and which have support feet for engaging a wall surface of a building against which the ladder is placed.

Snyder, US 2013/0055648, teaches a roof mounted gutter guard device with unfolding arms which extend for the purpose of receiving a support rail. The deployed support rail allows ladders to be supported away from the roofline and gutters in a safe and effective manner. The deployed support rail of the gutter guard device is also used to hang decorations and other accessories from the rail without placing stress on the roofline and gutters.

SUMMARY OF THE PRESENT INVENTION

The present invention teaches an assembly adapted to being affixed to an elevated location in order to provide a ladder support surface. The assembly includes an anchoring base subassembly, an elongated arm extending from the subassembly and a head mounted to an end of the arm and including an elongated crosswise member adapted to support an upper location of a ladder.

Additional features include at least one pivot axis established between the base subassembly and the arm and at least one additional pivot axis between the arm and the head. The base subassembly further includes a fixed mounting portion and a pivotally adjusted outer portion. The fixed mounting portion further includes a wall mount plate from which extends a pair of radial support plates, between which is received a pivotally supporting location of the outer portion to define a first of the at least one pivot axis.

The outer portion further includes a second pair of radial support plates and pivotally receiving therebetween a proximal end of the arm to define a second of the at least one pivot axis. The arm further includes an outer extension tube pivotally secured to the outer portion and an inner telescoping extension tube extending from the outer tube.

The head further includes an additional pair of spaced apart radial support plates for pivotally receiving a distal end of the inner telescoping portion in order to define the at least one additional pivot axis. The pair of spaced apart plate weldments extending from the head and receive the elongated crosswise member.

The elongated crosswise member further includes a pair of extending forks adapted to laterally support the ladder. A pulley is mounted to the crosswise member and is adapted to receive the lanyard.

BRIEF DESCRIPTION OF THE DRAWINGS

Reference will now be made to the attached drawings, when read in combination with the following detailed description, wherein like reference numerals refer to like parts throughout the several views, and in which:

FIG. 12B is an exploded view of the pivot head tilt assembly;

FIG. 13A is a perspective illustration of a pivot head tilt base plate of the tilt assembly;

FIG. 13B is a further perspective illustration of a pivot head tilt side plate of the tilt assembly.

DETAILED DESCRIPTION OF THE PREFERRED EMBODIMENTS

With reference to the attached illustrations, the present invention discloses a support assembly which is anchored or affixed to an elevated location for subsequently receiving an upper portion of a user supporting ladder. As will be further described, the ladder support assembly includes multiple axes of adjustment (three shown in the illustrated embodiment) which can be pre-configured upon attachment to the elevated location (such as via a separate ground supported power lift or other height extending platform) and in order to provide durable and repetitive support to the ladder when it is desired to be placed (leaned against) the elevated support. The ladder assembly is further capable of being either or both remounted or reconfigured along its multiple axes of motion and in order to adapt to a different support protocol.

Figure 15:
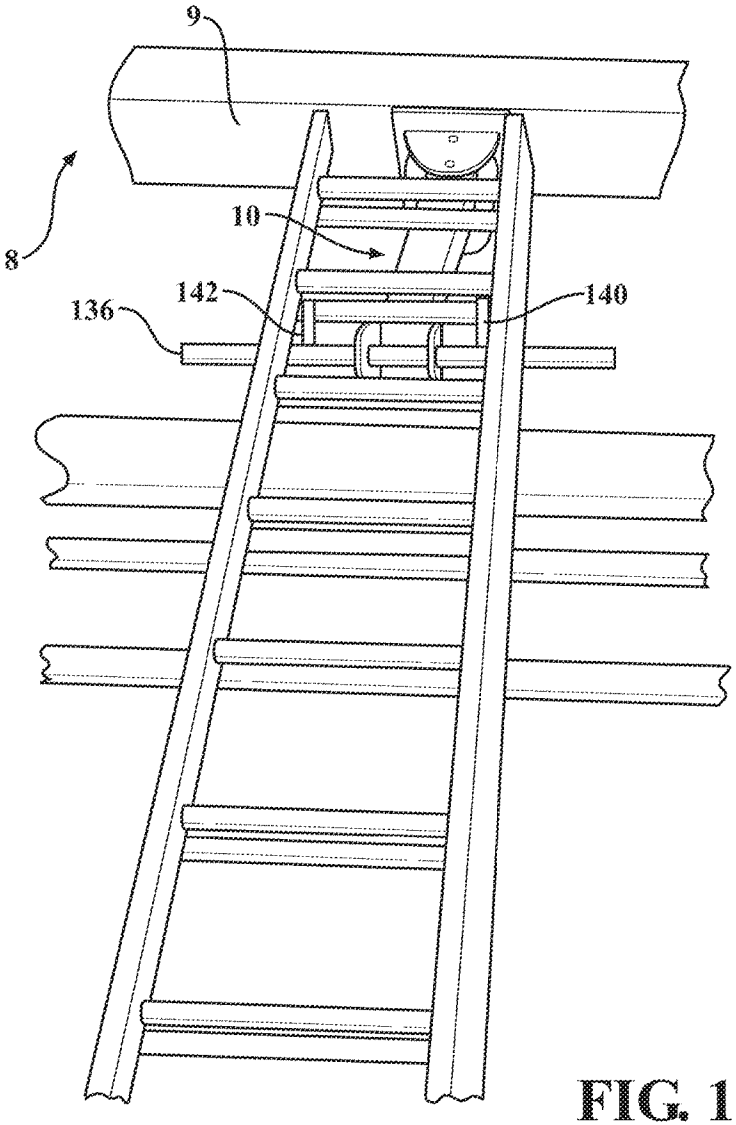
FIGS. 14 and 15 are a pair of environmental installation views of the ladder support subassembly depicted in varied elevated and multi-axial adjusted configurations for supporting an upper location of such as an extendable ladder and in order to allow access to an elevated work location.
Figure 14:
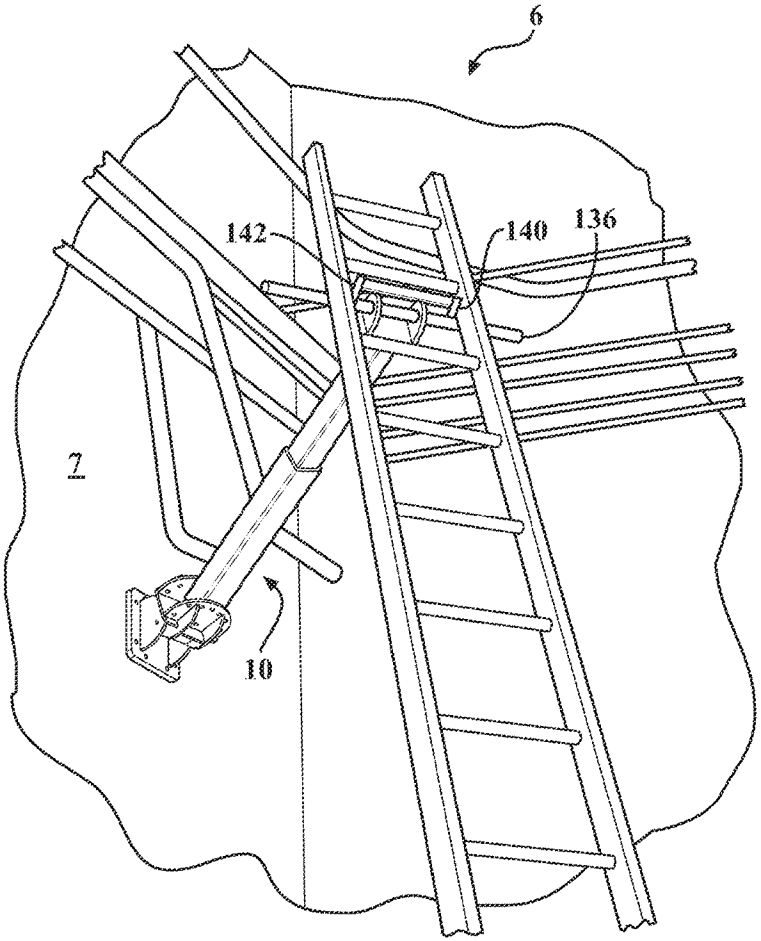

In this fashion, and depending upon the placement of the support assembly, the multiple axes can be readjusted in any number of configurations such as in order to permit a strategically mounted assembly to be reconfigured to provide a number of varied ladder support directions or orientations, such permitting a variety of access options to workers during maintenance or surveying of overhead equipment at different locations, this as best depicted in the environmental views of FIGS. 14-16. As will also be described, a preferred embodiment contemplates each axis of adjustment between the base, arm and head portions being oriented (and locked in place) prior to weight supporting placement of the ladder, with the present invention also contemplating options in which a limited degree of adjustability of the assembly can be undertaken with the ladder supported against it.

Figure 1:
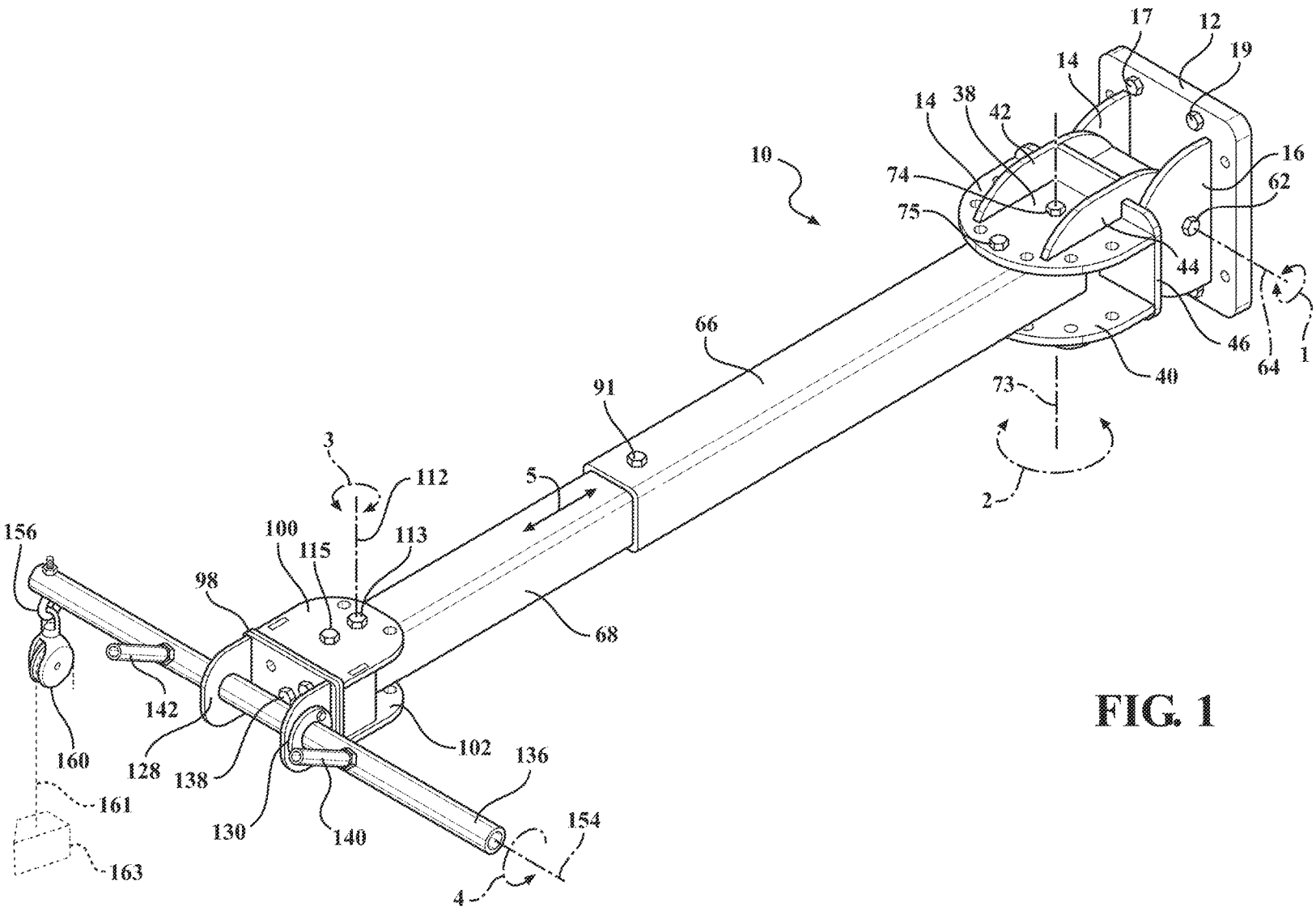
FIG. 1 is a perspective view of a ladder support assembly according to one non-limiting embodiment of the present invention.
Figure 2A:
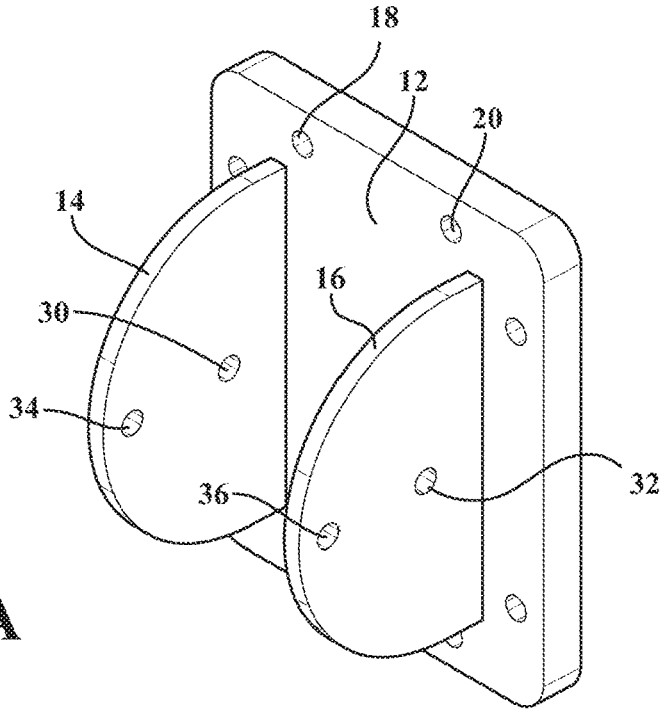
FIGS. 2A and 2B are a pair of perspective assembled and exploded views of a portion of the wall mount bracket of FIG. 1.
Figure 2B:
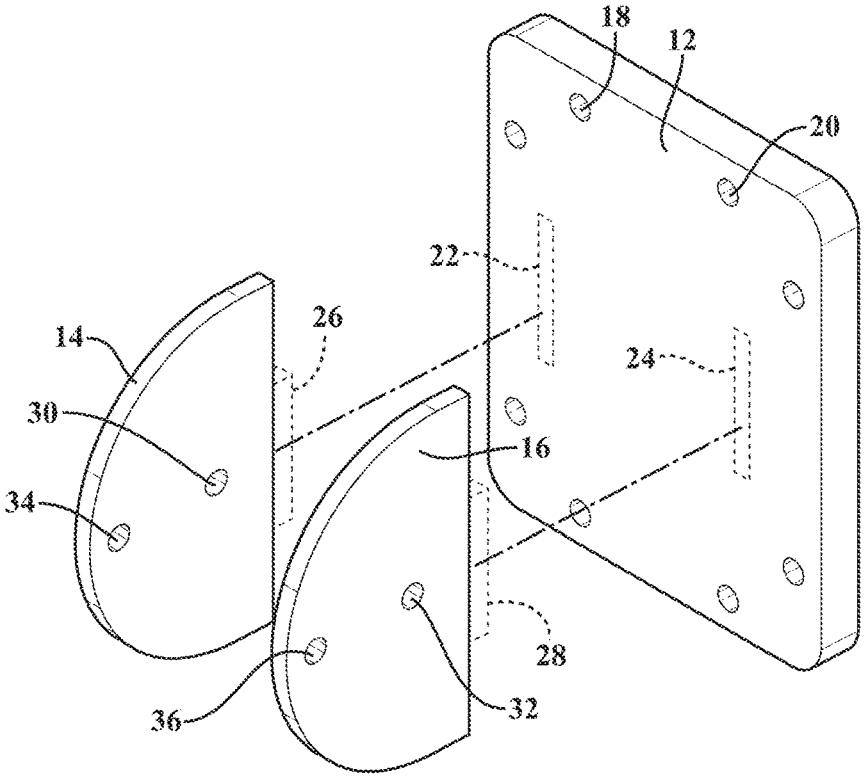
Figure 3B:
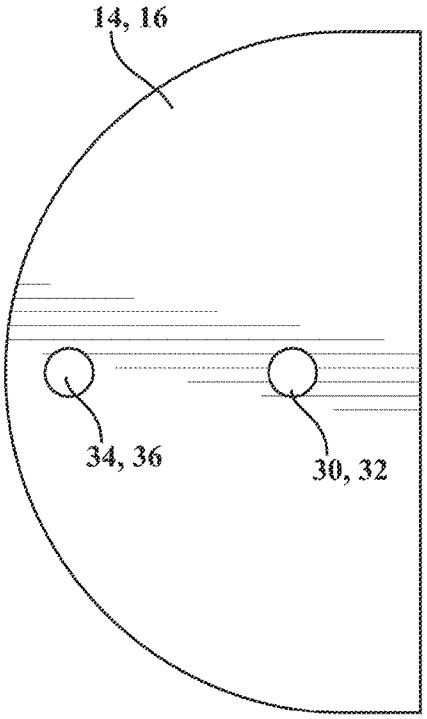
FIG. 3A is a plan view illustration of a wall mount radius plate forming a portion of the present assembly and FIG. 3B is a plan view of a wall mount radius plate forming a further portion of the present assembly; series of plan line art views of the wall mount bracket of FIG. 2.
Figure 3A:
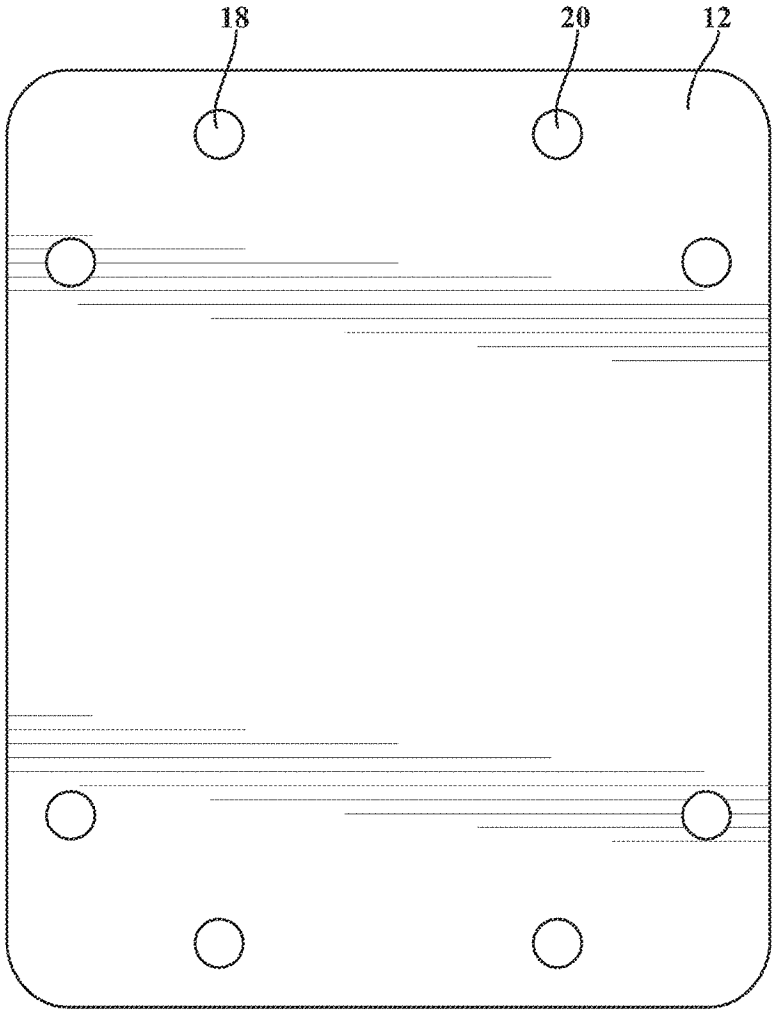

With reference now to FIG. 1, as well as to each of the succeeding breakout illustrations of FIGS. 2-15, a ladder support assembly is generally shown at 10 according to one non-limiting design of the present inventions. The ladder assembly is constructed to provide adjustable and re-securable orientations according to multiple axis of rotation (see each of bi-directional rotation locations 1, 2, 3, and 4 in FIG. 1) which, when combined with telescoping bi-directional adjustment (as further shown at 5 in relation to inner and outer extension tubes), enables the ladder assembly to be reconfigured within an installation environment to provide repetitive and secure support to an upper end of such as an extension ladder. As further shown, the first 1 and fourth 4 axes of articulation are parallel, as are the second 2 and third 3, it being understood that that the axes of orientation can be modified from that shown without departing from the scope of the invention.

Referring to FIGS. 14 and 15, a pair of environmental installation views are shown respectively at 6 and 8 of the ladder support subassembly depicted in varied elevated and multi-axial adjusted configurations for supporting an upper location of such as an extendable ladder and in order to allow access to an elevated work location. In the instance of the installation of FIG. 14, the ladder assembly 10 is depicted mounted to a reinforced wall location 7 in proximity to a plurality of conduits, whereas in FIG. 15 the assembly is secured to an underside surface of a horizontally extending rectangular beam 9.

The illustrations of FIG. 14-15 are intended to depict the variety of different installation environments to which the ladder support assembly can be reconfigurable to within the scope of the present invention, to reposition the head tube weldment and fork of the assembly to provide a secure abutment surface for the upper region of the ladder, and to prevent the same from sliding out of engagement. This can again include the head tube of the assembly 10 (as will be further described at 136) providing the abutment surface against with the ladder is leaned, with the pair of forks (further at 140 and 142) extending from the head tube projecting typically through and beyond the interior spaced between the extending sides of the ladder and successive of the interconnecting rungs, this so as to prevent lateral sliding or displacement of the ladder. Without further limitation, the ladder can include any conventional design and can be a one piece or multi-piece extensible ladder.

Addressing the various components of the ladder assembly 10 of the present invention, it includes a base or wall mount subassembly for anchoring to an elevated support location (such as to in interior or exterior wall surface). The base subassembly is also further depicted in breakout FIGS. 2A-2B and 3A-3B and includes a wall mount plate 12 from which extend a pair of radial spaced apart plates 14 and 16. The wall mount plate 12 includes a collection of apertures defined therein (see perimeter defined apertures 18, 20, et. seq.) for receiving mounting bolts or fasteners (see at 17 and 19 in FIG. 1) for mounting to the elevated surface.

In one non-limiting application, a pair of slots 22/24 (see as shown in phantom) may be configured in vertical fashion within the wall mount plate 12 and are configured to receive projecting tabs, additionally shown in phantom at 26/28 associated with end mounting surfaces of the radial plates 14/16. Given the typical steel construction of the various components of the present assembly, a series of welds (also not shown) are provided for fixing the plates 14/16 to the base plate 12.

It is also envisioned that the mounting slots 22/24 and tabs 26/28 can be dispensed with and the end surfaces of the plates 14/16 directly welded to the base plate 12. It is also envisioned and understood that the base and radial plate combination can be mechanically secured together in some other fashion or may be cast as a single piece. It is also envisioned that, alternative to a steel construction, the various components of the present assembly can also be constructed of a durable material not limited to an injection molded polymer exhibiting high durability and impact resistant characteristics.

The radial plates 14/16 each further include an aligning inner aperture, see at 30 and 32, as well as a further aligning outer pair of apertures 34 and 36. As will be discussed below, the pairs 30/32 and 34/346 of apertures in the radial support plates 14/16 align to provide first and second mounting positions for re-securable pivotal mounting and adjustment of a gimbal weldment subassembly (see again articulating rotation 1 in in FIG. 1).

As further shown in FIGS. 1 and 4A-5C, an outer portion of the pivotally attachable gimbal weldment subassembly includes a pair of horizontal plates 38/40, interlocking and outer curved vertical plates 42/44 and supporting plate 46. The outer subassembly (again also termed gimbal weldment) is assembled to create a generally box shaped structure, such as again via additional weldments if individually assembled from steel components.

The supporting plate 46 also includes slots 48/50 for receiving rear inserting locations 52/54 of the plates 38/40, with the side/vertical plates 42/44 being likewise configured to include inner facing support surfaces (see pairs 46/48 and 50/52) for seating the horizontal plates 38/40 between. Additional pairs of notched locations 51/53 and 55/57 in the side plates 42/44 also receive projecting tabs (see at 59/61 along one visible side in FIG. 4) of horizontal plates 38/40 in order to assemble together in the desired spatial arrangement. Upper 47 and lower 49 tab projections are associated with the rear plate 46 and define abutment locations for the side plates 42/44 to properly align with the horizontal plates 38/40 in the manner best shown in each of FIGS. 4A and 4C.

A pair of aligning apertures 56/58 are formed in rear locations of the curved side plates 42/44 and, as shown in FIG. 1, are positioned between either pair of apertures 30/32 or 34/36 in the wall mount radius shaped plates 14/16 to receive a pivot bolt 62 (FIG. 1) with associated tightening nut (not shown) threadably secured over a threaded shaft end of the bolt in order to lock the outer support portion of the base subassembly at a desired orientation relative to the base mount plate 12 about associated pivot direction 1 (see also pivot axis 64 in FIG. 1).

Figure 6A:
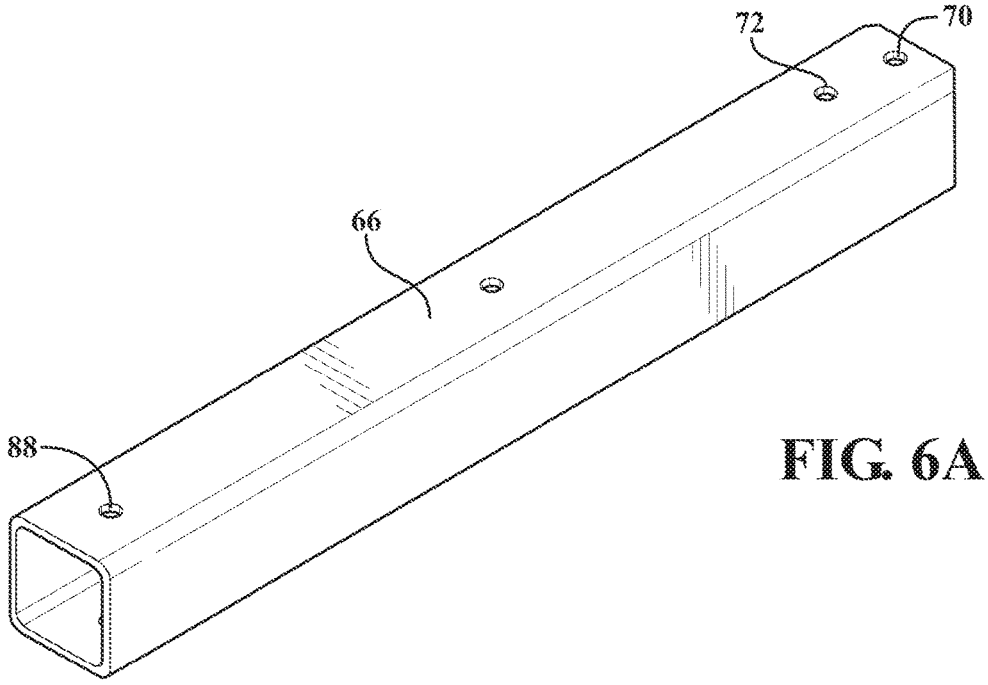
FIG. 6A is a perspective illustration of the outer extension tube and FIG. 6B is a perspective illustration of the inner extension tube.
Figure 6B:
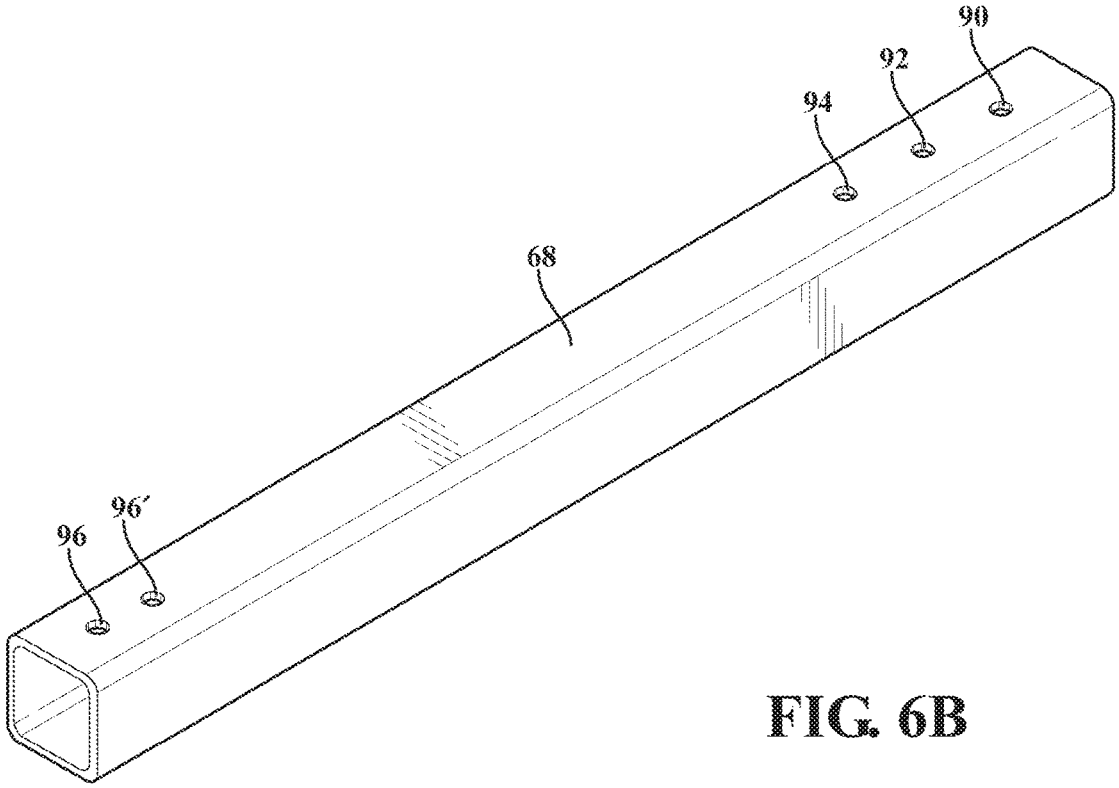

Referring to FIG. 1 in combination with FIGS. 6A-6B, an arm associated with the ladder support assembly includes an outer telescoping tube 66 (FIG. 6A) and an inner telescoping tube 68 (FIG. 6B). The outer tube 68 includes a first proximal end located aperture 70 which aligns with a pair of aligning apertures 65/67 in the horizontal gimbal plates 38/40 in order to receive a further drop in bolt 71 (see FIG. 1) to establish the pivotal range 2 defined in FIG. 1 as defined about an axis 73.

Figure 4A:
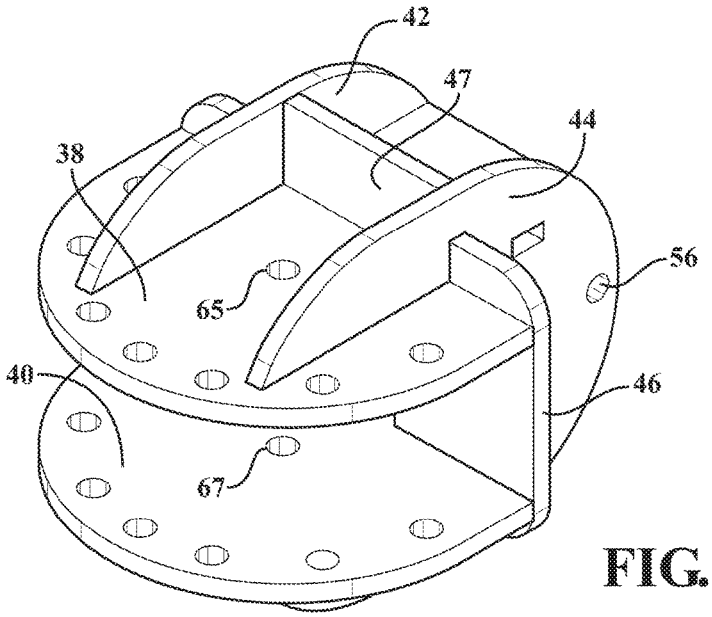
FIG. 4A is a perspective assembled view and FIG. 4B is an exploded view of a gimbal weldment assembly for anchoring to the radius plates of the wall mount bracket.
Figure 4B:
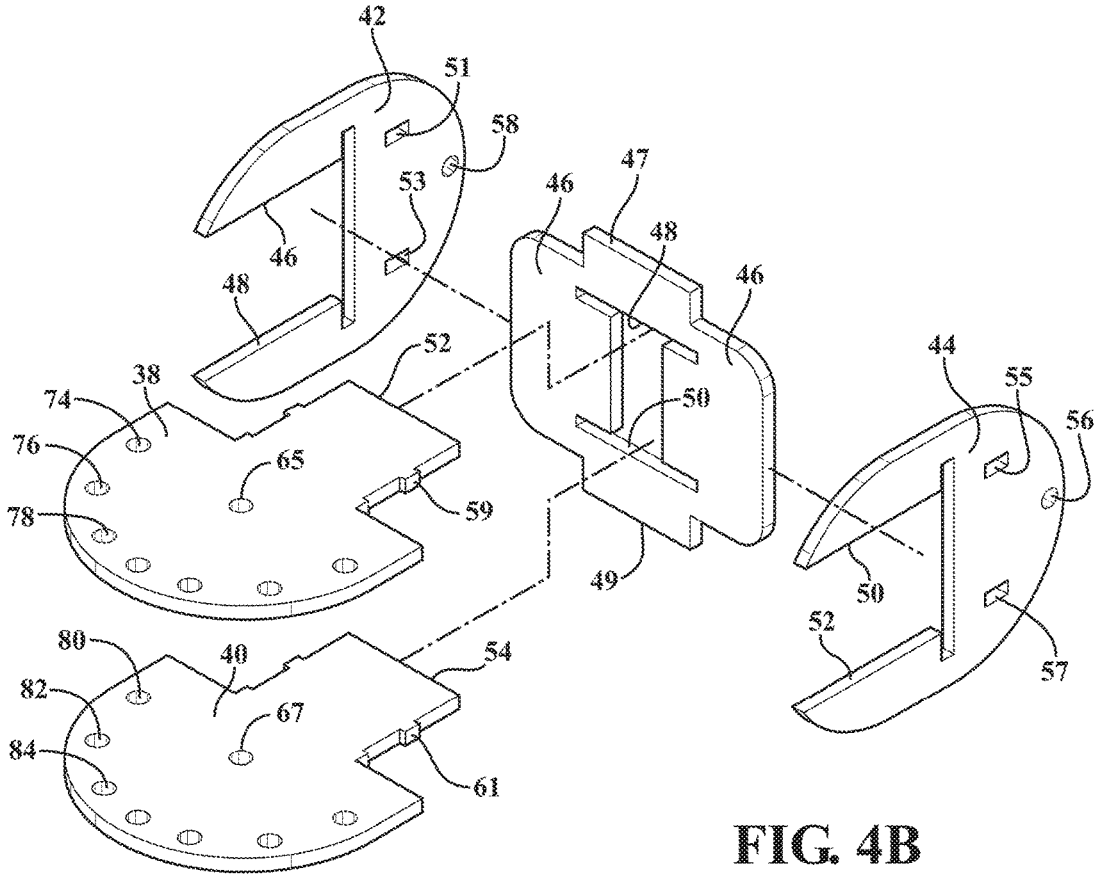
Figure 4C:
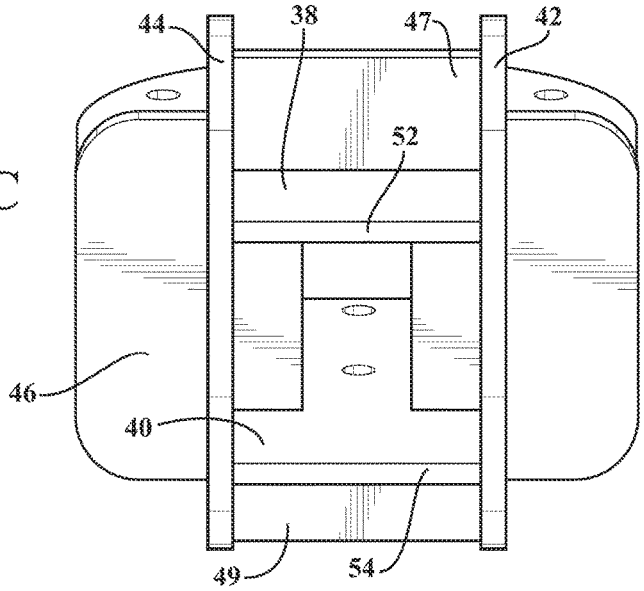
FIG. 4C is a rear perspective of the gimbal weldment assembly.
Figure 5A:
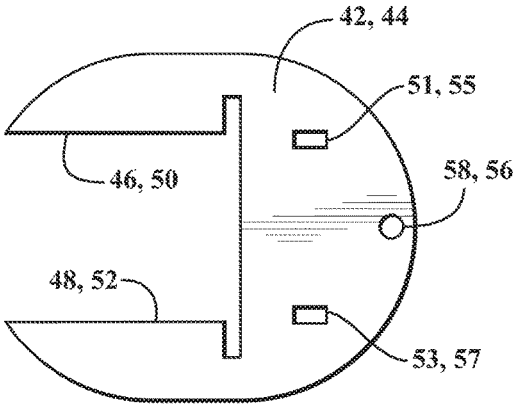
FIG. 5A is a plan view illustration of a gimbal vertical plate of the gimbal weldment assembly.
Figure 5B:
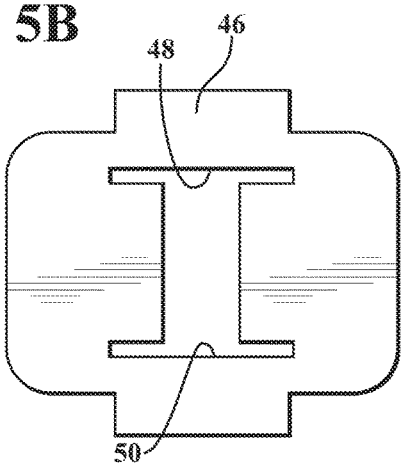
FIG. 5B is an illustration of a gimbal main plate of the gimbal weldment assembly.
Figure 5C:
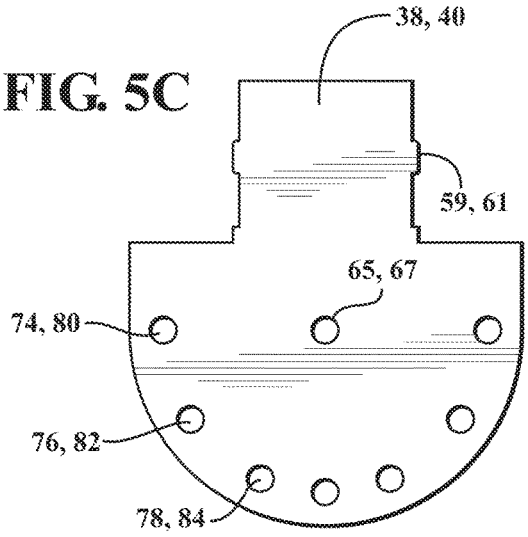
FIG. 5C is an illustration of a gimbal horizontal plate of the gimbal weldment assembly.

Aligning pluralities of outer radial apertures are formed in each of the horizontal spaced plates, see at 74, 76, 78, et seq. for plate 38 and further at 80, 82, 84, et seq. for plate 40 as previously depicted in FIG. 4B. A further aperture 72 in the outer tube 66 (see again FIG. 6A) is located proximate the aperture 70 can be aligned with any pair 74/80, 76/82, 78/84, etc.) upon pivoting the tube 66 about the pivot pin 71 and in order to receive a further detent or drop in pin (at 75 in FIG. 1) in order to fix a desired angular orientation of the arm relative to the outer support portion plates 38/40.

A further distal end aperture 88 in the outer tube can be aligned with any one of a plurality of individual apertures (see at 90, 92 94, et seq.) defined in spaced apart fashion along the inner tube 68 (FIG. 6B) and in order to receive an additional drop in fastener, bolt or pin (at 91 in FIG. 1) in order to establish a desired overall length of the arm as defined by the telescoping inter-displacement of the outer and inner tubes. A distal end of the inner extension tube 68 includes a further aperture 96 and, optionally, a second proximate distal end aperture 96'. As also shown, the tubes 66/68 are rectangular in cross sectional profile and can also envision any other mating configuration which dissuades inter-rotation of the inner and outer tubes.

Figure 10A:
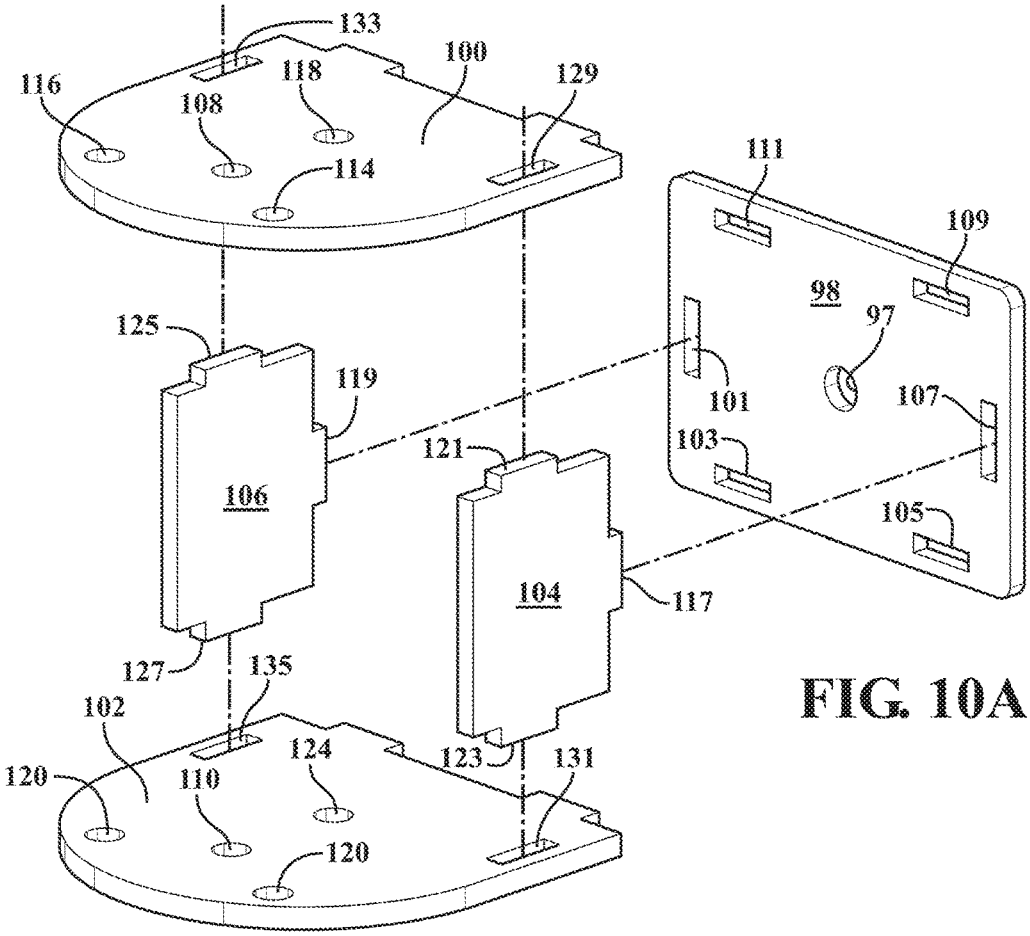
FIG. 10A is an exploded view and FIG. 10B is an assembled perspective view of the pivot head base weldment assembly.
Figure 10B:
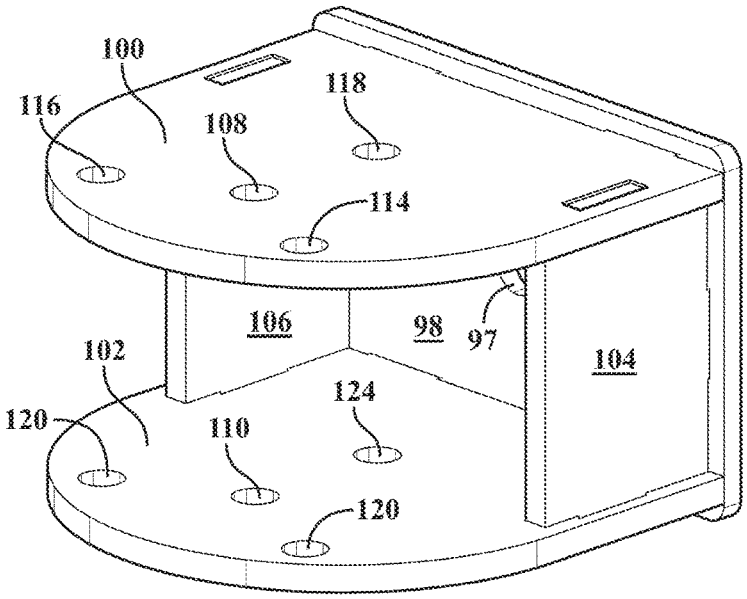
Figure 11A:
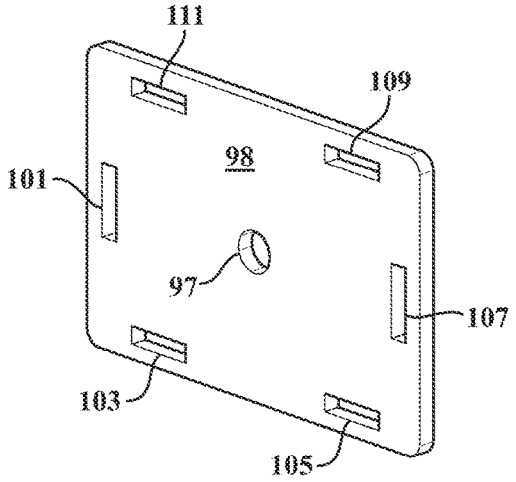
FIG. 11A is a perspective illustration of a pivot head tilt base of the pivot head base weldment assembly.
Figure 11B:
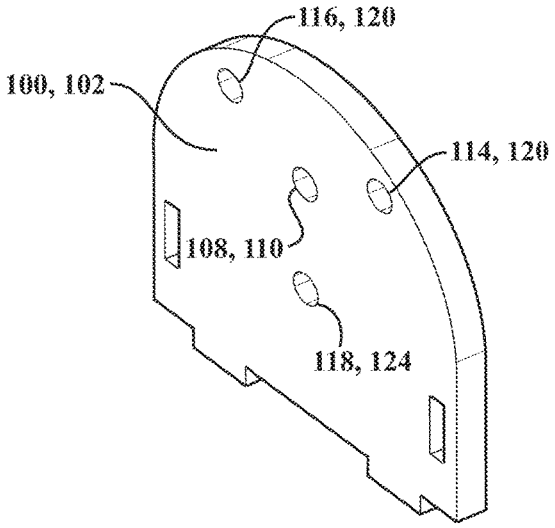
FIG. 11B is a perspective illustration of a pivot head tube side of the pivot head base weldment assembly.
Figure 12A:
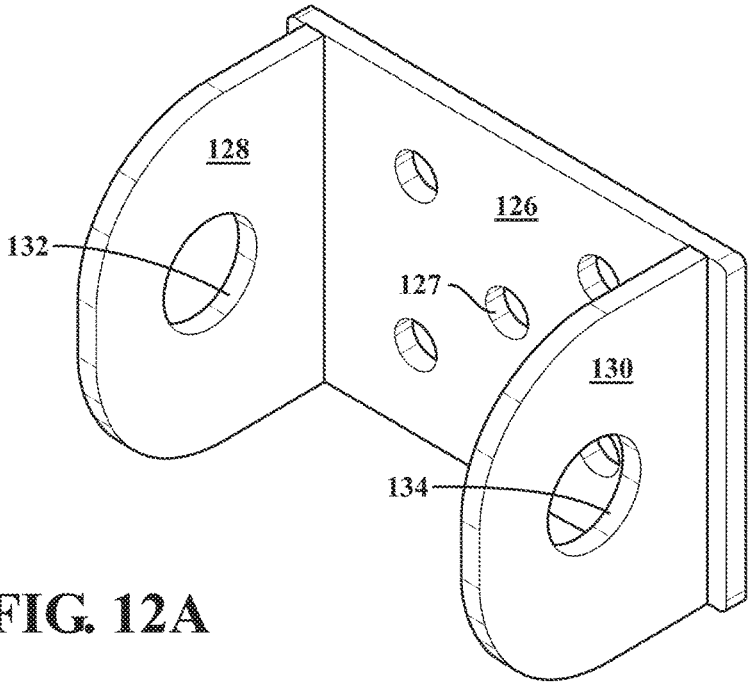
FIG. 12A is an assembled view of the pivot head tilt assembly.

As best shown from viewing FIG. 1 in combination with FIGS. 10A-10B, a pivot head weldment assembly includes a pivot head assembly face 98 (with a mounting aperture 97 defined therein for mounting a pivot head tilt assembly as which will be further described in FIGS. 12A-13B). The pivot head weldment assembly assembles, such as by welding, a pair of top 100 and bottom 102 pivot head plates and inter-supporting side plates 104 and 106 in order to create a component which receives the distal end of the inner tube 68 between the curved outer profile of the plates 100/102. The plates 100/102 each further include central aligning apertures 108/110 which align with the distal aperture 96 in the inner tube 68 and, upon inserting a pin 113, to pivotally mount the head about an axis 112 (FIG. 1).

Additional aperture patterns 114, 116, 118 (plate 100) and 120, 122, 124 (plate 102) are shown in FIG. 10 in the plates 100 and 102, these capable of being respectively aligned and, upon pivoting relative to the distal end of the extending inner tube 68, can receive a further bolt 115 (again FIG. 1 with a further aligning aperture in the distal arm or other engaging structure not being shown) in order to establish a desired angular orientation of the head relative to the distal arm. This can include utilizing the pair of apertures 96 and 96' in the distal end of the inner tube 68 in order to define varying angular orientations of the pivot head weldment assembly relative to the elongated inner tube arm 68.

The pivot head face 98 further includes an arrangement of slots 101-111 at perimeter spaced locations for receiving tabs 117 and 119 projecting from the rear edges of the side plates 104/106 in addition to tabs extending from the rear edges of the top and bottom plates 100/102. Additional pairs of upper and lower tabs 121/123 and 125/127 in the side plates also seat through aligning slots 129/131 and 133/135 in the upper 100 and lower 102 plates and, in combination with the side receiving tabs 117/119 assemble to create the pivot head weldment assembly, such which can be welded or otherwise secured together in the indicated configuration.

The head further includes an outer support (also termed a pivot head tilt assembly) for receiving the crosswise ladder support tube, and this is shown in each of FIGS. 12A, 12B, 13A and 13B, by a plate base 126 (including an array of apertures including a central most aperture at 127, the plate base 126 also including slots 129/131) and extending/attachable pair of outer ears 128/130. Each of the ears 128/130 include rear edge tabs 133/135 for securing to the slots 129/131, the ears each further include an aperture, defined by inner perimeter surface 132/134, for receiving a cross tube 136 therethrough (see FIGS. 7-8), the tube 136 mounting in the manner depicted in FIG. 9 and which can be welded to the ears 128/130. The plate base 126 is secured to the underlying surface of the pivot head tilt assembly face 98 such as by any of welds, weldments or fasteners (see at 138 in FIG. 9) which can mount through aligning apertures in the components including the mounting aperture 97 in the face plate 98 of the pivot head weldment assembly for attaching the pivot head tilt assembly to the pivot head weldment assembly.

Figure 7:
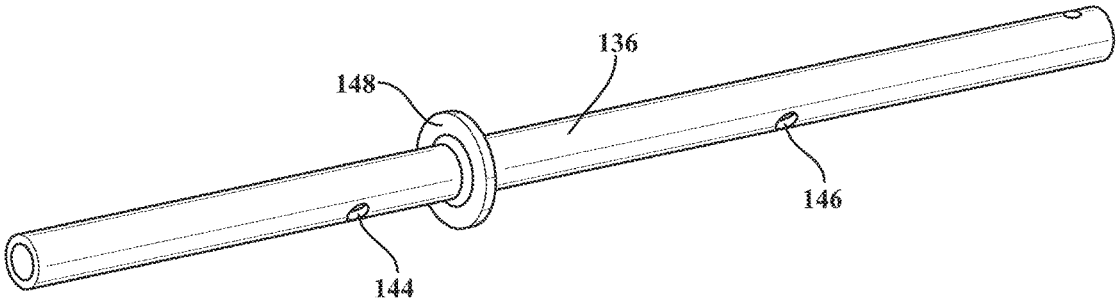
FIG. 7 is an illustration of a head tube and welded fixation ring associated with the head tube weldment assembly.
Figure 8:
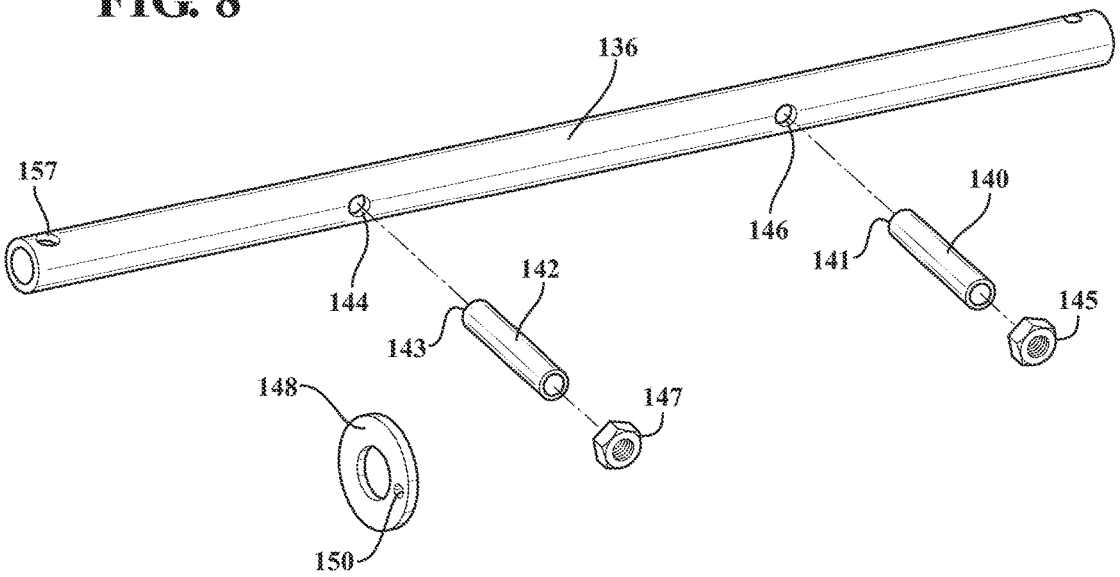
FIG. 8 is an exploded view of head tube with weld or otherwise attachable fork and fixation ring.

Referring to FIGS. 7-8, the cross tube 136 includes a pair of tube shaped mounting forks 140 and 142 extending from surface locations thereof, the forks defining an orientation which adapts to abut lateral surfaces of the ladder as shown in FIGS. 14-15. As shown, the head tube forks 140/142 can be configured with a forward inserting end (such having a break sharp edge profile at 141/143) for mounting in the apertures 144/146 defined in the cross tube 136. The inserting ends of the tube forks can be welded to the tube 136 or can be threadably inter-engaged with opposing interior threads formed in the inserting apertures 144/146 of the cross tube 136.

Hex nuts 145/147 can also be provided and in a first application can be welded to the exterior of the tube 136 (see FIG. 9) for threadably receiving opposing threaded ends of the tube forks 140/142. Other non-illustrated applications can also include attaching the nuts (or providing an additional pair of nuts) to likewise opposite exposed threaded ends of the tube forks (see FIG. 8) such as in order to provide additional abutting locations for assisting in restraining the upper end of the ladder once supported against the cross tube.

Figure 9:
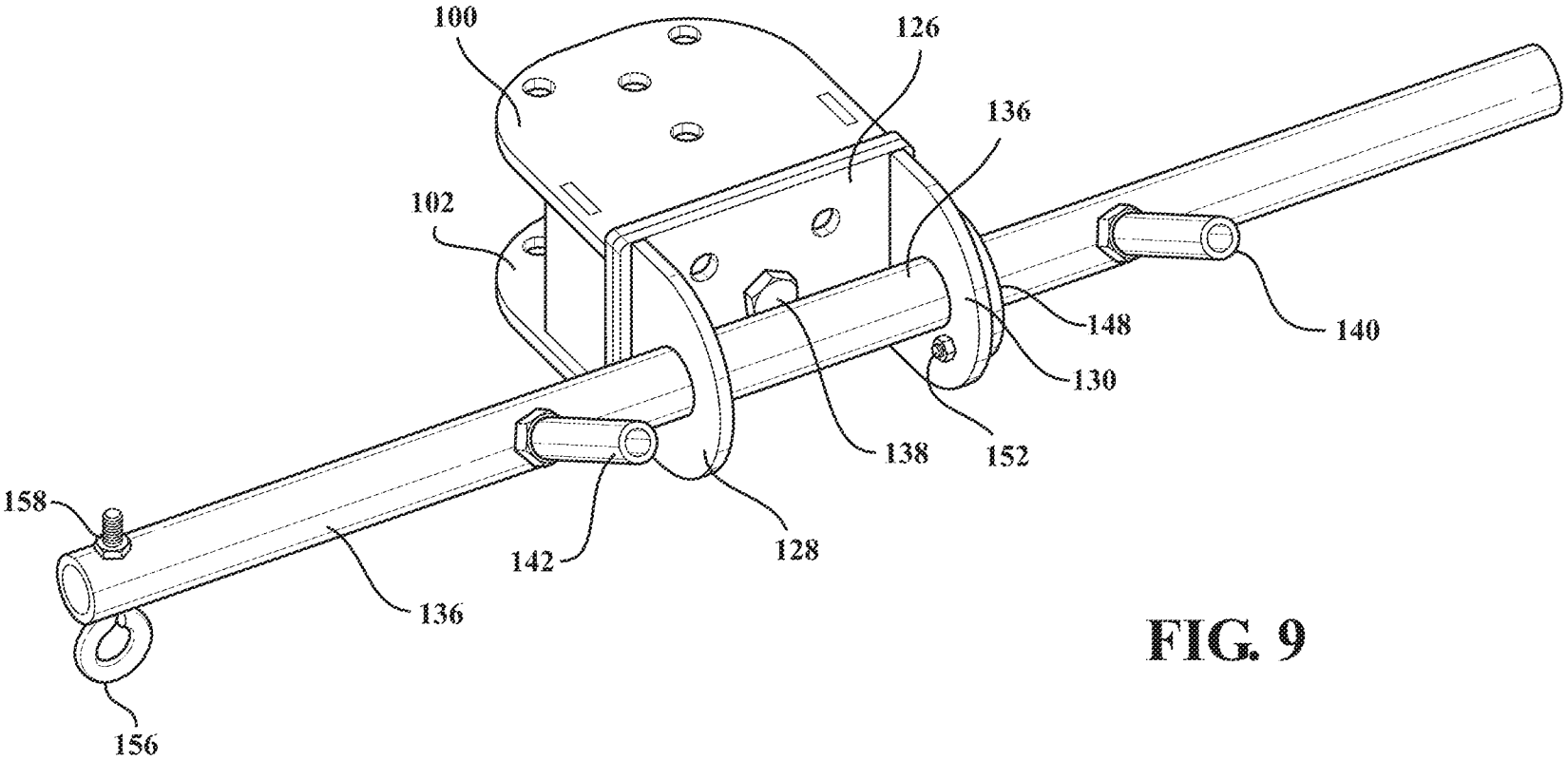
FIG. 9 is a perspective view of the pivot head weldment assembly, pivot head tilt assembly and head tube fork assembly with pulley mount.

A head tube fixation ring 148, also termed a lock washer, is provided and which is seated at an intermediate location of the cross tube 136 in order to abut such as exterior surfaces of a selected guiding ear or lobe 130 (FIGS. 1 and 9). An outer radial aperture 150 (FIG. 8) is configured at an annular location of the head lock ring or washer 148 and receives a nut and fastener arrangement 152 (see in FIG. 9) in order to anchor the cross tube 136 against each of lateral and rotating displacement relative to the ears or lobes 128/130. In this fashion, the tube head forks 140/142 are prevented from rotating out of displacement with the side support locations of the ladder, with loosening and re-tightening of the nut/fastener 152 allowing for rotational readjustment of the ladder support tube 136 and projecting tube forks 140/142 about the further rotational bi-direction 4 (see axis 154 in FIG. 1).

An eye bolt 156 is secured through an end aperture 157 of the support tube 136, with a nut 158. A pulley 160 (FIG. 1) is attached to the eye bolt 156 and receives a length of line or lanyard 161 to permit a user standing atop the ladder to retrieve or lower any reasonably weighted item 163 tied to a given end of the lanyard.

Accordingly, the present invention teaches a multi-position, multi-axial adjustable ladder support assembly which is capable of being secured at an elevated location against which it is desired to lean a conventional ladder. Upon mounting of the wall mount assembly at a desired elevated location (not limited to that depicted in alternate variants of FIGS. 14-15), the present invention provides the ability to adjust and lock into position the ladder assembly about each of the axes of articulation (at 1 for axis 64 established between the wall mount assembly and gimbal weldment assembly, at 2 for axis 73 established between the gimbal weldment assembly and the outer extension tube, at 3 for axis 112 established between the inner telescoping extension tube and the pivot head weldment assembly and at 4 for axis 154 between the ladder support head tube/forks and supporting ears of the pivot head tilt assembly), combined with the axial or telescoping adjustment provided between the outer and inner extension arms (at 5).

In this manner, the ladder support assembly provides the ability to durably reconfigure and re-secure the ladder support tube and extending ladder in any conceivable orientation for supporting the upper leaning end of the ladder (again FIGS. 14-15), such again permitting permanent or repetitive access to an elevated location which, absent the ladder support, would not provide an adequate and safe support surface for the ladder. It is further understood that the range of reconfiguration of the ladder support assembly 10 enables a wide variety of re-adjustable positions and orientations for a given mounting location, such enabling a single such assembly to be reconfigured in a variety of orientations for accessing proximately located elevated infrastructure (pipes, HVAC equipment, conduits or other). Additionally, the ability to utilize the pulley and lanyard mounted to the support assembly 10, as opposed from the ladder itself, and to retrieve and lower items from the elevated location provides additional convenience not known in the prior art.

Having described my invention, other and additional preferred embodiments will become apparent to those skilled in the art to which it pertains, and without deviating from the scope of the appended claims:

I claim:

1. A support assembly affixed to an elevated location for providing leaning support to an upper end of a ladder, comprising:

a wall mount subassembly including a mounting plate adapted to secure to the elevated location;

a gimbal weldment subassembly repositionable relative to said wall mount subassembly about a first axis;

a tube subassembly repositionable at a proximal end relative to said gimbal weldment subassembly about a second axis;

a pivot head weldment subassembly repositionable relative to a distal end of said tube subassembly about a third axis;

a head tube subassembly supported in crosswise extending fashion relative to said pivot head weldment subassembly and against which is adapted to being supported the upper end of the ladder a pivot head tilt subassembly affixed to said pivot head weldment subassembly, a pair of extending ears of said tilt subassembly each having an interior aperture for receiving said head tube subassembly in laterally inserting fashion such that said head tube subassembly is rotationally repositionable about a fourth axis;

a head tube fixation ring seated at an intermediate location of said head tube in order to abut such as exterior surfaces of a selected one of said extending ears; and an outer radial aperture configured at an annular location of said fixation ring for receiving a nut and fastener arrangement in order to anchor a cross tube of said head tube subassembly at a rotational position relative to said extending ears.

2. The support assembly of claim 1, said tube subassembly further comprising an outer extension tube pivotally secured to said gimbal weldment subassembly and an inner extension tube telescopically adjustable relative to said outer tube and pivotally secured to said pivot head weldment subassembly.

3. The support assembly of claim 1, said head tube subassembly further comprising a pair of pins extending therefrom at spaced apart locations for laterally supporting the ladder.

4. The support subassembly of claim 1, further comprising an eye bolt secured to an end proximate location of said head tube subassembly, a pulley mounted to said eye bolt and adapted to receive a lanyard for raising and lowering a load secured to an end of said lanyard.

5. The support assembly of claim 1, said wall mount subassembly, said gimbal weldment subassembly, and said pivot head weldment subassembly each further comprising a plurality of inter-assembleable plate components.

6. The support assembly of claim 5, further comprising a plurality of weldments for securing each of said plurality of said plate components.

* * * * *